US006059004A

United States Patent [19]

Oskam

[11] Patent Number: 6,059,004

[45] Date of Patent: May 9, 2000

[54] WINDOW BLIND OR SHADE

[75] Inventor: Herman Oskam, Vlisterdijk, Netherlands

[73] Assignee: Hunter Douglas International N.V., Netherlands Antilles

[21] Appl. No.: 09/114,864

[22] Filed: Jul. 13, 1998

[30] Foreign Application Priority Data

Jul. 14, 1997 [EP] European Pat. Off. ..... 97305186

[51] Int. Cl.[7] ..... A47H 5/00

[52] U.S. Cl. ..... 160/84.04; 160/84.01; 160/166.1; 160/173; 160/178.1; 24/115 R

[58] Field of Search ..... 160/84.01, 84.04, 160/116.1 R, 173 R, 178.1 R, 279, 321, 322, 290.1; 24/115 R

[56] References Cited

U.S. PATENT DOCUMENTS

| | | | |
|---|---|---|---|
| 2,410,546 | 11/1946 | Olson | 160/168.1 R |
| 3,727,665 | 4/1973 | Debs | 160/168.1 R X |
| 4,557,309 | 12/1985 | Judkins | 160/279 X |
| 4,673,018 | 6/1987 | Judkins . | |
| 4,687,038 | 8/1987 | Clemente | 160/279 X |
| 4,739,815 | 4/1988 | Altman | 160/84.01 |
| 4,762,159 | 8/1988 | Ford | 160/84.1 |
| 4,940,070 | 7/1990 | Warden | 160/176.1 R |
| 5,176,192 | 1/1993 | Judkins et al. | 160/84.1 |
| 5,485,875 | 1/1996 | Genova | 160/168.1 R |
| 5,553,649 | 9/1996 | Chisaka et al. | 160/168.1 R |
| 5,579,819 | 12/1996 | Hung et al. | 160/178.1 R |
| 5,613,540 | 3/1997 | Jelic | 160/84.04 |
| 5,671,793 | 9/1997 | Lee | 160/168.1 R |

FOREIGN PATENT DOCUMENTS

| | | |
|---|---|---|
| 0192867 | 4/1989 | European Pat. Off. . |
| 1107055 | 3/1968 | United Kingdom . |

*Primary Examiner*—Daniel P. Stodola
*Assistant Examiner*—Bruce A. Lev
*Attorney, Agent, or Firm*—Dorsey & Whitney LLP

[57] ABSTRACT

An apparatus for regulating the length of the lift cord in an architectural covering such as a window blind or shade is preferably positioned on the bottom rail of the shade and includes two component parts. One component part is secured to an end of the lift cord, and the second component part is operatively engaged with the bottom rail and a connector is provided for adjusting the relative position of the parts so as to conveniently regulate the relative positions of the end of the lift cord and the bottom rail. The apparatus, therefore, provides a convenient way for adjusting the bottom rail of the covering so that it is properly positioned relative to the window sill or the like.

19 Claims, 2 Drawing Sheets

WINDOW BLIND OR SHADE

CROSS REFERENCE TO RELATED APPLICATION

This application claims priority to European application No. 97305186.5 filed Jul. 14, 1998.

BACKGROUND OF THE INVENTION

1. Field of the Invention

This invention relates to an architectural covering, particularly a covering for an architectural opening, such as a window blind or shade.

2. Description of the Related Art

Conventional blinds and shades for windows have included a head rail, a bottom rail, one or more window covering elements extending between the head rail and the bottom rail, at least two lift cords extending from the head rail and supporting the bottom rail, and a mechanism to limit the downward movement or drop of the bottom rail.

For pleated or roman shades, the drop height of the shades has usually been limited by a cord connector, engaging the cord outlet at the bottom of the head rail upon full drop of the bottom rail. Sometimes, pleated and roman shades have also been provided with an additional cord to limit drop. On the other hand, for venetian blinds, the full drop has usually been limited by the full extension of the ladder cords.

Limiting drop, without additional cords, by making use of the lift cord has presented obvious advantages because fewer elements are used in assembling the blinds or shades. Experience has shown, however, that providing the proper effective lengths of the lift cords between the head rail and the bottom rail for controlling drop has not always been easy. Conventional shades have had a minimum of two lift cords co-extending through the shade members and holding the bottom rail at several locations spaced along its length. The free ends of these lift cords have extended through the head rail to an exit opening or cord lock in one of its longitudinal ends, and the free ends have optionally been joined or knotted together in a cord connector outside the head rail. The effective length of the lift cords might be the length of the cords as they extend between the head rail and the bottom rail or from the cord connector to the bottom rail. The effective length of the lift cords determines the orientation of the bottom rail relative to the head rail.

Accurate adjustment of drop has also been important because the bottom rail should not hit the window sill, nor should it be suspended too high, so that an unsightly gap exists between the bottom rail and the window sill. However, it has not always been easy to set precisely the drop by adjusting the final location of a knot along the lift cords, at least prior to making the knot.

BRIEF SUMMARY OF THE INVENTION

According to this invention, an architectural covering, such as a window blind or shade, is provided which has a head rail, a bottom rail, a covering element extending between the head rail and the bottom rail, at least two lift cords extending from the head rail and supporting the bottom rail and means to limit the downward movement of the bottom rail and which also comprises an adjuster connected to at least one of the lift cords; the adjuster having: a first part, to which an end of the cord is secured; a second part engaging the bottom rail or the head rail; and means to adjust the relative position of the first and second parts.

With the adjuster of this invention, regardless of whether one accurately positions the knot originally in the lift cord of a shade or blind for a particular window height, one can subsequently adjust the position of the knot, so that the bottom rail has a full drop which is correct for the particular window. This is particularly important where two or more lift cords are knotted together and the position of their knot must be adjusted to provide the correct drop for the bottom rail.

The adjuster of the invention can be mounted in the bottom rail and be connected to the lower end of a lift cord. With such an arrangement, it is preferable that the second part of the adjuster form an end cap for the bottom rail. Alternatively for blinds provided with a cord connector which connects the lift cords and abuts the head rail, the adjuster can be provided in the cord connector and be connected to the upper end of the lift cords. In either embodiment, the means to adjust the relative position of the first and second parts preferably comprises a screw connector between the first and second parts.

Further aspects of the invention will be apparent from the detailed description below of particular embodiments and the drawings thereof, in which:

DETAILED DESCRIPTION OF THE INVENTION

Figure 1:
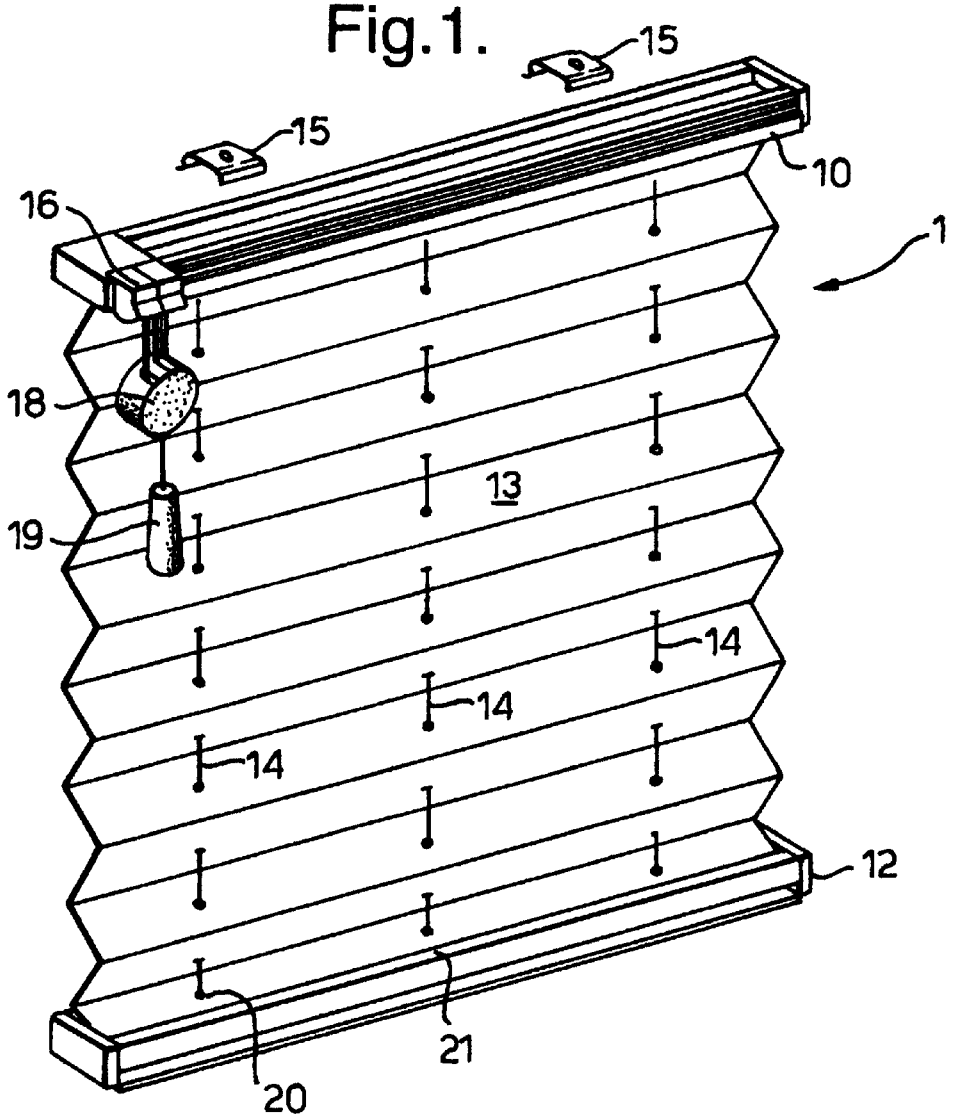
FIG. 1 is a perspective view of a pleated blind.

The pleated blind 1, shown in FIG. 1, includes a conventional, longitudinally-extending head rail 10 and bottom rail 12 and a pleated window covering material 13 extending between the head and bottom rails, all of which are supported by three conventional lift cords 14. Conventional brackets 15 are provided for mounting the head rail 10 on a wall, adjacent to a window (not shown). The lift cords 14 pass over conventional guide means in the head rail 10 and then out of the bottom of the head rail through a cord lock 16. The three lift cords 14 are connected by a conventional connector 18, from which a tassel 19 depends. This allows one to raise and lower the blind 1 by pulling downwardly on the tassel 19 to raise and lower the connection of the lift cords 14 to the bottom rail 12.

The connector 18 also serves to limit the drop height of the blind 1 by limiting the downward movement of the bottom rail 12. In this regard, the connector 18 engages the cord lock 16 at the limit of the drop height, whereby the connector 18 cannot go upwardly any further and, as a result, the bottom rail cannot go downwardly any further.

The bottom ends of the three cords 14 are knotted together in a conventional manner (not shown) after each cord has been passed through one of the three openings 20 in the top surface 21 of the bottom rail 12. However, as mentioned above, it is never certain that the lengths of all the cords 14 above the knot (not shown in FIG. 1) have been accurately set for the desired lowermost position of the bottom rail 12.

Figure 2:
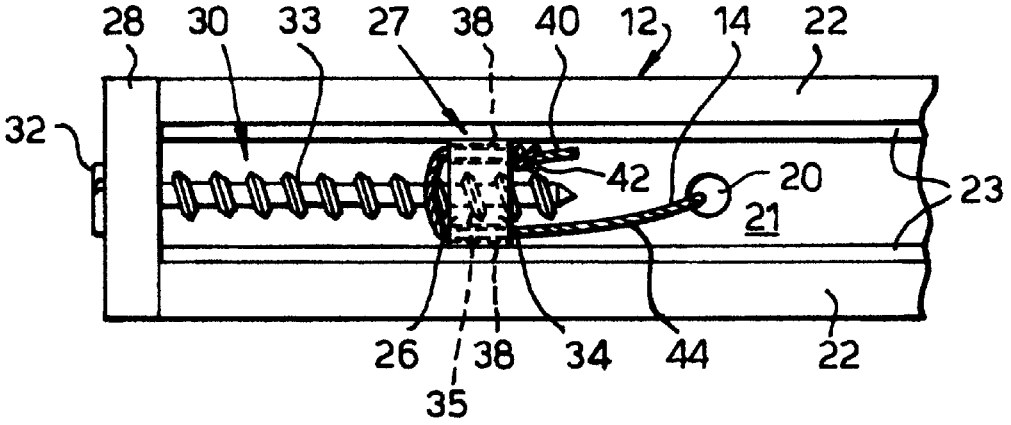
FIG. 2 is a schematic upward view of the interior of the bottom rail of the blind of FIG. 1, containing an adjuster of this invention.
Figure 3:
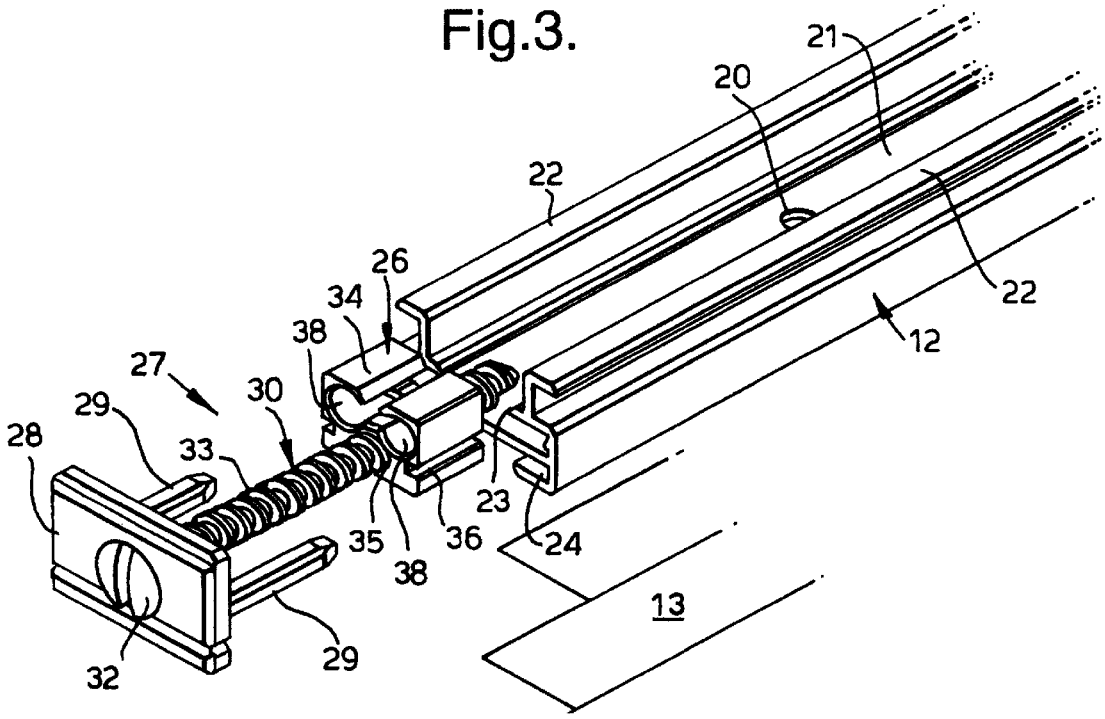
FIG. 3 is an upward exploded perspective view of the bottom rail of the blind of FIG. 1, containing the adjuster of this invention.

Referring now to FIGS. 2 and 3, the bottom of the bottom rail 12 is of channel section and is provided with laterally opposite, i.e., front and rear, flanges 22 that extend longitudinally and laterally away from each other and with laterally opposite ribs 23 that extend longitudinally and laterally towards each other, above the flanges 22. The ribs 23 act as longitudinally-extending guide rails for a first part 26 of an adjuster 27 of this invention as described below. The top of the bottom rail 12 is provided with laterally opposite flanges 24 that extend longitudinally and laterally towards each other and serve to hold a second part 28 of the adjuster 27 on the end of the bottom rail 12. In this regard, a pair of laterally opposite prongs 29, which extend longitudinally from the second adjuster part 28, can be inserted and frictionally held between the flanges 24 and the top surface 21 of the bottom rail 12.

The second adjuster part 28 forms an end cap for the bottom rail 12, thereby securely engaging the bottom rail. Passing longitudinally through the second adjuster part 28 is a longitudinally-elongate adjuster screw 30 having a head 32 outside the end of the bottom rail 12 and a screw portion 33 within the bottom rail. The screw portion 33 of the adjuster screw 30 passes longitudinally through an aperture 35 in a lowered central portion 34 of the first adjuster part 26. Preferably the screw portion 33 of the adjuster screw 30 is self-tapping and forms a female thread on the walls of the aperture 35 of the first adjuster part 26.

Rotation of the screw head 32 of the adjuster screw 30, with a conventional screwdriver, will cause the first adjuster part 26 to move longitudinally to the left or right, depending on the direction of rotation of the adjuster screw, towards or away form the second adjuster part 28. In this regard, longitudinally-extending grooves 36 are provided on laterally opposite sides of the lowered portion 34 of the first adjuster part, and the ribs 23 of the bottom rail 12 can ride within the grooves 36 when the first adjuster part is moved longitudinally. If the first adjuster part 26 is molded from a plastic material or rubber, it will have a self-locking effect on the adjuster screw 30, thereby preventing unwanted longitudinal movement of the first adjuster part.

The lowered central portion 34 of the first adjuster part 26 also has, on laterally opposite sides, two longitudinally-extending slots or elongate recesses 38, through each of which all the lift cords 14 pass in a longitudinal direction. Each lift cord 1 4 passes through both of the slots 38 and along the side of the first adjuster part 26 closest to the second adjuster part 28, and the lift cord ends 40 are then knotted together on the other side of the first adjuster part 26, remote from the second adjuster part 28. The resulting knot 42, formed by the ends 40 of the lift cords 14, is preferably held by the lift cords against this other side of the first adjuster part 26, remote from the second adjuster part 28, by the weight of the bottom rail 12 suspended from the lift cords 14 as shown in FIG. 2.

The remainder 44 of each lift cord 14 (only one of which is shown in FIG. 2) then passes from the first adjuster part 26, upwardly through one of the openings 20 in the top wall 21 of the bottom rail 12 and then through the window covering material 13 to the head rail 10.

With the blind 1 of the invention, one can approximately set the drop of the bottom rail 12 by providing the knot 42 of the lift cords 14 at an appropriate position at the ends 40 of all the lift cords 14. Then, a fine adjustment of the drop of the bottom rail can be achieved by moving the first adjuster part 26 relative to the second adjuster second part 28, using its screw 30.

Additionally or alternatively, a similar adjuster can be provided in the cord connector 18. Also if desired, an adjuster 27 can be provided at each end of the bottom rail 12, thereby allowing the length of each individual lift cord above the bottom rail to be adjusted, so that the bottom rail 12 is perfectly level.

This invention is, of course, not limited to the above-described embodiment which may be modified without departing from the scope of the invention or sacrificing all of its advantages. In this regard, the terms in the foregoing description, such as "left", "right", "longitudinal", "lateral", "upper", "lower", "bottom" and "top", have been used only as relative terms to describe the relationships of the various elements of the window shade or blind of the invention.

What is claimed is:

1. An architectural covering which has a head rail, a bottom rail, a covering element extending between the head rail and the bottom rail, at least two lift cords extending from the head rail and supporting the bottom rail and means for adjusting the effective length of the lift cords to limit the downward movement of the bottom rail, said means comprising an adjuster that is within one of said head rail and bottom rail and is connected to a lift cord; the adjuster having: a first part, to which an end of the lift cord is secured; a second part engaging one of said rails; and means operatively connected to and extending between the first and second parts and being accessible from exteriorly of said rail to adjust the relative position of the first and second parts.

2. The architectural covering of claim 1 wherein the lift cords are knotted together and the position of their knot is to be adjusted to provide a level drop for the bottom rail.

3. The architectural covering of claim 1 wherein the adjuster is mounted in the bottom rail and is connected to a lower end of a lift cord.

4. The architectural covering of claim 3 wherein the second part of the adjuster forms an end cap for the bottom rail.

5. The architectural covering of claim 4 wherein the first part of the adjuster is connected to a lower end of the lift cord.

6. The architectural covering of any one of claims 1, 2, 4, or 5 wherein the means to adjust the relative position of the first and second parts comprises means for adjusting the distance between the first and second parts.

7. The architectural covering of claim 6 wherein the means to adjust the relative position of the first and second parts comprises a screw connector between the first and second parts.

8. The architectural covering of claim 3 wherein the means to adjust the relative position of the first and second parts comprises means for adjusting the distance between the first and second parts.

9. The architectural covering of claim 8 wherein the means to adjust the relative position of the first and second parts comprises a screw connector between the first and second parts.

10. The architectural covering of claim 1 wherein the means to adjust the relative position of the first and second parts comprises means for adjusting the distance between the first and second parts.

11. The architectural covering of claim 10 wherein the means to adjust the relative position of the first and second parts comprises a screw connector between the first and second parts.

12. An architectural covering which has a head rail, a bottom rail, a covering element extending between the head rail and the bottom rail, at least two lift cords extending between the head rail and the bottom rail for supporting the bottom rail, and adjusting means for adjusting the effective length of the lift cords to limit the downward movement of the bottom rail, said means comprising an adjuster positioned in one of said rails and being directly connected to a lift cord, said adjuster having a first part to which the lift cord is directly secured, a second part directly engaging the rail in which the adjuster is positioned, and means operatively interconnecting the first and second parts to selectively effect movement therebetween and to adjust the effective length of the lift cord that is secured to said first part between said head rail and bottom rail.

13. The architectural covering of claim 12 wherein the lift cords are knotted together and the position of their knot is to be adjusted to provide a correct drop for the bottom rail.

14. The architectural covering of claim 12 wherein the adjuster is mounted in the bottom rail and is connected to a lower end of a lift cord.

15. The architectural covering of claim 14 wherein the second part of the adjuster forms an end cap for the bottom rail.

16. The architectural covering of claim 15 wherein the first part of the adjuster is connected to a lower end of the lift cord.

17. The architectural covering of any one of claims 12, 13, or 15 wherein the adjusting means comprises means for adjusting the distance between the first and second parts.

18. The architectural covering of claim 17 wherein the means to adjust the relative position of the first and second parts comprises a screw connector between the first and second parts.

19. An architectural covering which has a head rail, a bottom rail, a cord connector, a covering element extending between the head rail and the bottom rail, at least two lift cords extending from the head rail and supporting the bottom rail and means for adjusting the effective length of the lift cords to limit the downward movement of the bottom rail, said means comprising an adjuster connected to at least one of said lift cords; the adjuster having a first part to which an end of said at least one lift cord is secured; a second part engaging said cord connector; and means to adjust the relative positions of the first and second parts, said connector connecting said at least two lift cords and being adapted to abut said head rail to limit the downward movement of the bottom rail, and wherein the adjuster is positioned in said cord connector.

* * * * *